US008011400B2

(12) United States Patent
Suzuki

(10) Patent No.: US 8,011,400 B2
(45) Date of Patent: Sep. 6, 2011

(54) COMPRESSED WOOD PRODUCT AND ELECTRONIC DEVICE EXTERIOR MATERIAL

(75) Inventor: Tatsuya Suzuki, Tokyo (JP)

(73) Assignee: Olympus Corporation, Tokyo (JP)

( * ) Notice: Subject to any disclaimer, the term of this patent is extended or adjusted under 35 U.S.C. 154(b) by 0 days.

(21) Appl. No.: 12/338,717

(22) Filed: Dec. 18, 2008

(65) Prior Publication Data

US 2009/0101237 A1 Apr. 23, 2009

Related U.S. Application Data

(63) Continuation of application No. 11/065,966, filed on Feb. 24, 2005, now abandoned, which is a continuation of application No. PCT/JP2005/001279, filed on Jan. 21, 2005.

(30) Foreign Application Priority Data

Jan. 21, 2004 (JP) ..... 2004-013237
Jan. 21, 2004 (JP) ..... 2004-013238
Jan. 21, 2004 (JP) ..... 2004-013239

(51) Int. Cl.
*B27M 3/00* (2006.01)

(52) U.S. Cl. ..... 144/359; 428/106; 144/381; 144/360

(58) Field of Classification Search ..... 144/358, 144/359, 361, 381, 360; 428/105, 106, 113, 428/174; 264/112–114
See application file for complete search history.

(56) References Cited

U.S. PATENT DOCUMENTS

| | | | | |
|---|---|---|---|---|
| 1,831,350 | A * | 11/1931 | Hall | 473/547 |
| 2,787,306 | A | 4/1957 | Lundstrom et al. | |
| 5,415,943 | A * | 5/1995 | Groger et al. | 428/537.1 |
| 5,682,936 | A * | 11/1997 | Higdon, Jr. | 144/345 |
| 5,746,863 | A * | 5/1998 | Jarrett | 156/218 |
| 5,817,202 | A * | 10/1998 | Seidner | 156/154 |
| 5,881,786 | A * | 3/1999 | Wilderman et al. | 144/348 |
| 6,418,990 | B1 * | 7/2002 | Lindstrom | 144/348 |
| 6,622,423 | B1 * | 9/2003 | Riccardi | 47/1.1 |
| 6,837,953 | B2 * | 1/2005 | Kai | 156/182 |
| 2002/0148532 | A1 * | 10/2002 | Kitazawa et al. | 144/361 |

FOREIGN PATENT DOCUMENTS

| | | |
|---|---|---|
| DE | 618230 | 9/1935 |
| FR | 898217 | 4/1945 |
| JP | 6-23708 | 2/1994 |
| JP | 08-25301 | 1/1996 |
| JP | 11-077619 | 3/1999 |
| JP | 3078452 | 6/2000 |
| RU | 43373 | 1/2005 |

* cited by examiner

*Primary Examiner* — Shelley Self
(74) *Attorney, Agent, or Firm* — Hogan Lovells US LLP

(57) ABSTRACT

A compressed wood product includes a wood whose shape is taken while a volume decreased by compression is previously added, wherein a direction intersecting a fiber direction of the wood is set to a compression direction, and the wood is formed by being subjected to compressive force.

4 Claims, 8 Drawing Sheets

COMPRESSED WOOD PRODUCT AND ELECTRONIC DEVICE EXTERIOR MATERIAL

CROSS-REFERENCE TO RELATED APPLICATIONS

This application is a continuation of application Ser. No. 11/065,966 filed Feb. 24, 2005, which is a continuation of international application No. PCT/JP2005/001279 filed on Jan. 21, 2005, which claims priority under 35 USC 119 to Japanese Patent Application Nos. 2004-013237, 2004-013238, and 2004-013239 filed on Jan. 21, 2004, the entire contents of which are incorporated herein by reference.

BACKGROUND OF THE INVENTION

1) Field of the Invention

The present invention relates to a compressed wood product including a compressed wood and an electronic device exterior material including the compressed wood product.

2) Description of the Related Art

Examples of a portable electric device which can be operated on hand include a camera, a mobile communication device (mainly cellular phone), an IC recorder, a PDA, a portable television, a portable radio, and remote controls for various home appliances. Usually, synthetic resins (ABS, polycarbonate, acrylic, and the like), light metals (aluminum, stainless steel, titanium, magnesium, and the like) are used as the exterior material for a portable electronic device due to industrial mass production. Such synthetic resins and light metals constituting the exterior material are oriented to industrial products while appropriate strength is obtained, so that there is no individual difference in appearance. Further, in the synthetic resins and the light metals constituting the exterior material, a flaw and discoloration are generated in long-term use. However, the flaw and the discoloration only impair the worth of the electronic device.

Therefore, it is thought that one may use wood which is of a natural raw material as the exterior material. Because the wood has various kinds of grain, the wood has the individual difference and individuality. Although the flaw and a change in color shade are generated in the long-term use in the wood, they become the unique feel and texture of the wood to cause users to feel an affinity.

However, when the wood is three-dimensionally processed for the exterior material, there is a fear for strength of the wood. Specifically in the exterior material made of wood, when the same strength as that of the synthetic resins or the light metals is demanded, since the increase in thickness of the wood is required, the wood is not suitable for the exterior material of the portable electronic device. On the other hand, in the exterior material made of wood, when the same size as that of the exterior material formed of the synthetic resins or the light metals is demanded, the strength is decreased because the thickness is made smaller. Therefore, in the conventional art, there is a technology in which the strength is obtained by compressing the wood as described below.

Conventionally a method is well known in which the wood softened by absorbing moisture is compressed and held to fix a shape, then is sliced in a compression direction to obtain a plate-shaped primary fixed product, the primary fixed product is formed in a formed product having a predetermined three-dimensional shape while heated and absorbed, and the shape of the formed product is fixed to obtain a secondary fixed product (for example, see Japanese Patent No. 3078452).

A method, in which a woody material compressed in a state in which the softening treatment is performed is temporarily fixed and then is recovered in a form to perform forming, is conventionally well known as a method of three-dimensionally processing the woody material (for example, see Japanese Patent Application Laid-Open No. 11-77619).

SUMMARY OF THE INVENTION

It is an object of the present invention to at least solve the problems in the conventional technology.

A compressed wood product according to one aspect of the present invention includes a wood whose shape is taken while a volume decreased by compression is previously added, wherein a direction intersecting a fiber direction of the wood is set to a compression direction, and the wood is formed by being subjected to compressive force.

DETAILED DESCRIPTION

Exemplary embodiments of a compressed wood product and an electronic device exterior material relating to the present invention will be explained in detail below with reference to the accompanying drawings.

Figure 1:
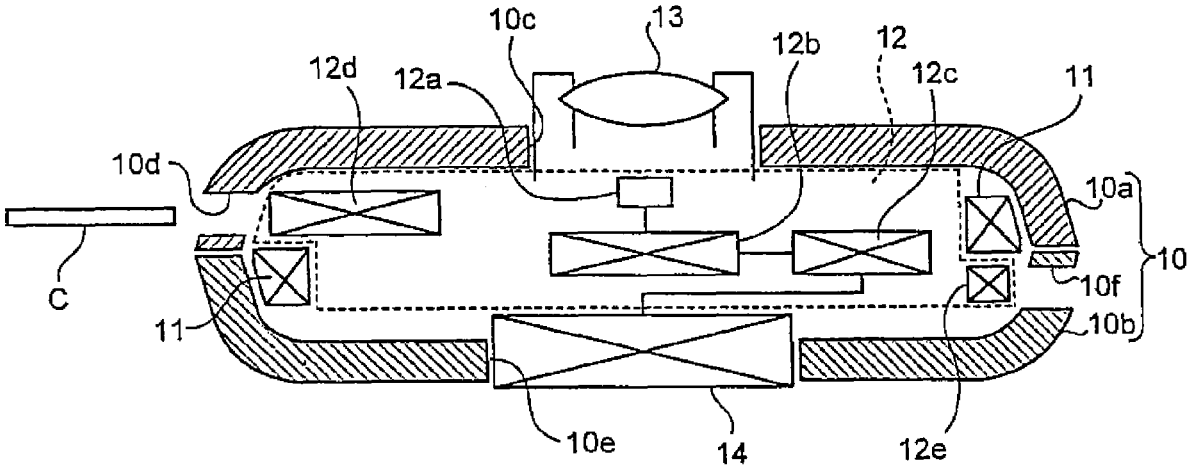
FIG. 1 is a sectional view that depicts an electronic device in which a compressed wood product according to a first embodiment is used as an exterior material.

FIG. 1 is a sectional view that depicts an electronic device in which a compressed wood product according to the first embodiment is used as an exterior material. In FIG. 1, a digital camera is shown as an example of the electronic device. The digital camera has a reinforcing frame 11 and an inner mechanism 12 inside an exterior material 10 formed by the compressed wood product. The digital camera also has an imaging lens 13 and a liquid crystal monitor 14 while the imaging lens 13 and the liquid crystal monitor 14 are exposed to the outside of the exterior material 10. The inner mechanism 12 includes an image pickup device 12*a* such as a CCD, a drive circuit 12*b* which drives the image pickup device 12*a*, a drive circuit 12*c* which drives the liquid crystal monitor 14, a recording device 12*d* for an image recording medium C, and a connection terminal 12*e* connected to an external personal computer.

The exterior material 10 includes a front cover 10*a* and a rear cover 10*b*. A lens hole 10*c* is made in a main plate portion of the front cover 10*a* so that the imaging lens 13 is projected outside of the front cover 10*a*. The lens hole 10*c* is made corresponding to an outer shape of a holding portion which holds the imaging lens 13. For example, when the holding portion has a cylindrical shape, the lens hole 10*c* is made in a circular shape so that the holding portion is projected outside of the front cover 10*a*. An aperture 10*d* is provided in a side plate portion of the front cover 10*a* so that the image recording medium C is inserted into or extracted from the aperture 10*d*. A rectangular window 10*e* is made in the main plate portion of the rear cover 10*b* so that the liquid crystal monitor 14 is exposed outside of the rear cover 10*b*. An aperture 10*f* is provided in the side plate portion of the rear cover 10*b* so that a connection cable connected to the connection terminal 12*e* is inserted into or extracted from the aperture 10*f*. In addition, although not shown in the drawings, button holes are provided on the front cover 10*a* and the rear cover 10*b* so that various operation buttons for operating the digital camera are exposed. A cover or the like may be provided in the button hole if needed.

Figure 2:
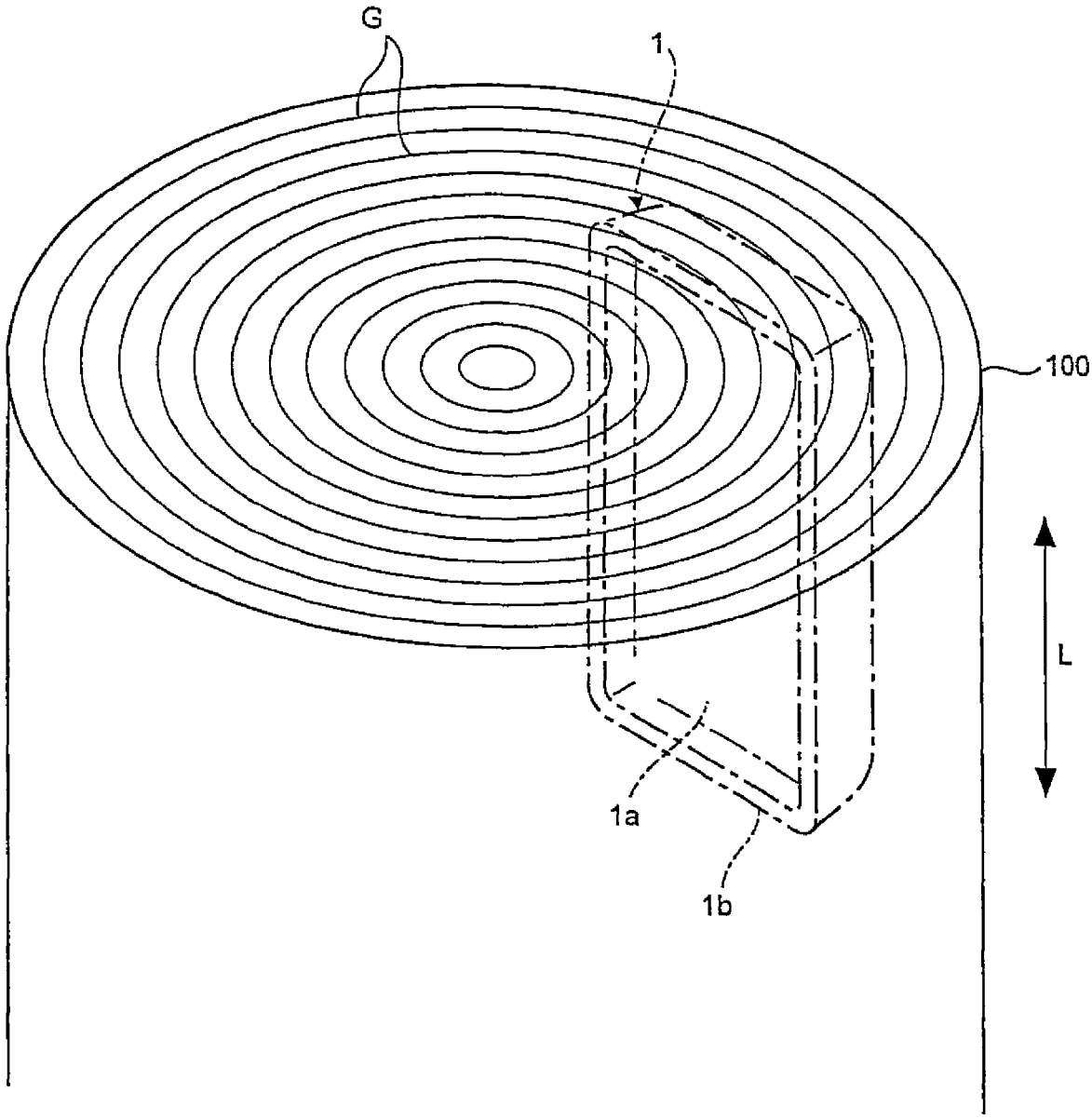
FIG. 2 is a perspective view that depicts shape-taking of a compressed wood product according to the first embodiment.
Figure 3:
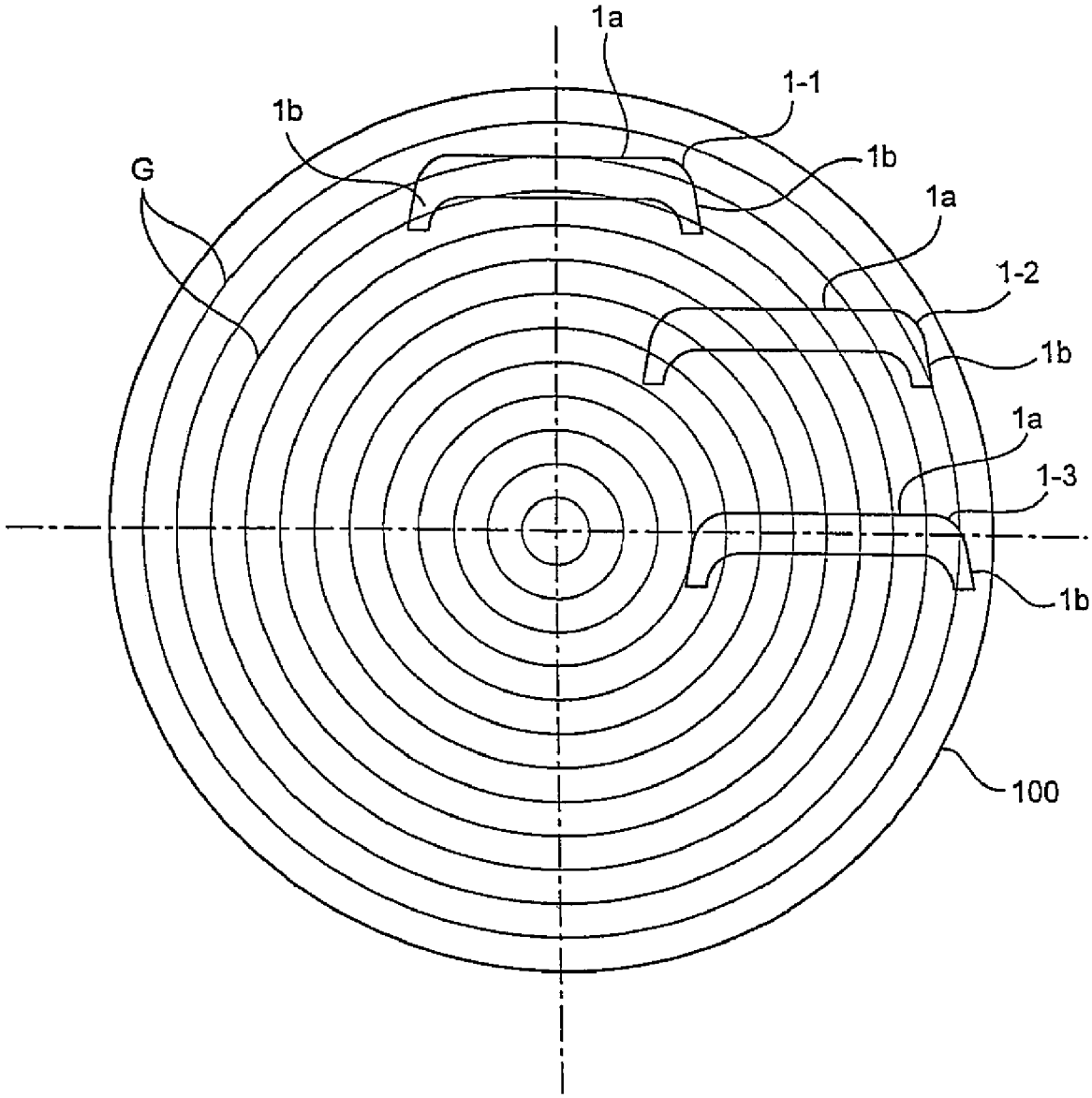
FIG. 3 is a plan view that depicts shape taking of a compressed wood product according to the first embodiment.

FIG. 2 is a perspective view that depicts shape taking of the compressed wood product according to the first embodiment, and FIG. 3 is a plan view that depicts shape taking of the compressed wood product according to the first embodiment. As shown in FIG. 2, the compressed wood product constituting the exterior material 10 is made by compressing a wood 1. The shape of the wood 1 is taken from a raw material 100 before the wood 1 is compressed. Examples of the raw material 100 include Japanese cypress (hinoki, hiba), paulownia (kiri), teak, mahogany Japanese cedar, pine, and cherry. The wood 1 is a lump including a main plate portion 1*a* having a predetermined shape (substantially rectangular shape in the first embodiment) and a side plate portion 1*b* provided while vertically rising from a periphery of the main plate portion 1*a*. The main plate portion 1*a* forms the main plate portion of the front cover 10*a* or the rear cover 10*b*, and the side plate portion 1*b* forms the side plate portion of the front cover 10*a* or the rear cover 10*b*. In the wood 1, the main plate portion 1*a* and the side plate portion 1*b* are formed so as to be coupled to each other in a curved surface. In the wood 17 as shown in FIG. 2, the shape of the main plate portion 1*a* is taken along a fiber direction L of the raw material 100, and particularly it is preferable that a lengthwise direction of the shape of the main plate portion 1*a* is taken along a fiber direction L.

As shown in FIG. 3, there are three modes in which the shape of the wood 1 is taken from the raw material 100, i.e. a wood 1-1, a wood 1-2, and a wood 1-3. In the wood 1-1, the pieces of grain G exist in a lamellar shape within a plate thickness of the main plate portion 1*a*, and the shape of the main plate portion 1*a* is taken while the surface emerging in the thickness direction has a flat-grain surface. In the wood 1-2, the pieces of grain G exist in an obliquely lamellar shape within the plate thickness of the main plate portion 1*a*, and the shape of the main plate portion 1*a* is taken while the surface emerging in the thickness direction has an edge-grain surface. In the wood 1-3, the pieces of grain G exist in the lamellar shape in the direction perpendicular to the plate thickness of the main plate portion 1*a*, and the shape of the main plate portion 1*a* is taken while the surface emerging in the thickness direction has a straight-grain surface.

Figure 4A:
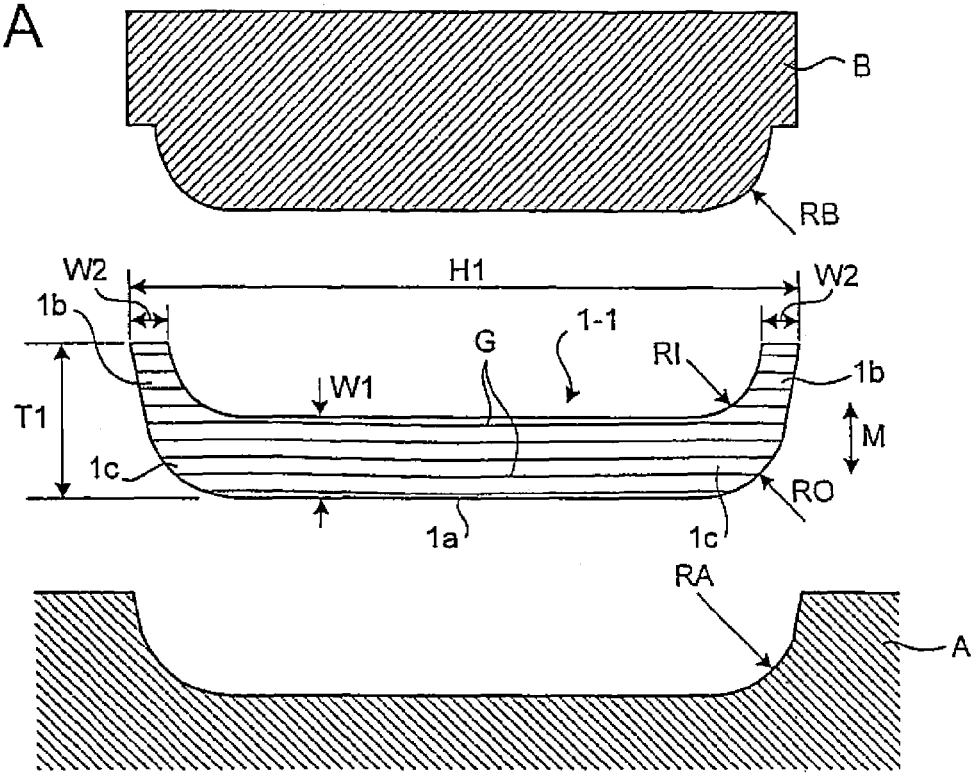
FIGS. 4A to 4C are views that depict a compression process in the first embodiment of the invention.

FIG. 4 is a view that depicts a compression process in the first embodiment. FIG. 4 shows the compression process of the wood 1-1 in which the main plate portion 1*a* has the flat-grain surface. The shape of the wood 1-1 is taken while a volume decreased by the compression is previously added. Specifically, as shown in FIG. 4A, the shape of the main plate portion 1*a* is taken with a thickness W1 in which the volume decreased by the compression is previously added. The shape of the side plate portion 1*b* is taken with a thickness W2 and a height T1 in which the volume decreased by the compression is previously added. The shape of the wood 1-1 is taken with a total width H1. The thickness W1 of the main plate portion 1*a* is formed larger than the thickness W2 of the side plate portion 1*b*. A middle portion between the main plate portion 1*a* and the side plate portion 1*b* is formed in the curve so that the thickness W1 of the main plate portion 1*a* is gradually changed to the thickness W2 of the side plate portion 1*b*. The side plate portion 1*b* is formed so as to rise obliquely outward from the main plate portion 1*a*. In the wood 1-1, FIG. 4 shows the shape of either the front cover 10*a* or the rear cover 10*b* in the exterior material 10 formed of the compressed wood product. The drawing and the description of the shape of the other are neglected because the shapes of the front cover 10*a* and the rear cover 10*b* are similar to each other.

The wood 1-1 is compressed between a lower mold frame A and an upper mold frame B. As shown in FIG. 4A, the lower mold frame A has a concave surface corresponding to a curved outside surface (lower surface in FIG. 4) in which the side plate portion 1*b* rises from the main plate portion 1*a* of the wood 1-1. The concave surface of the lower mold frame A has the shape to which the outside surface of the wood 1-1 is fitted. The radius of curvature of a curved surface RO at the outside surface of the wood 1-1 and the radius of curvature of a curved surface RA at the lower mold frame A which is opposite to the curved surface RO have a correlation of RO>RA. On the other hand, the upper mold frame B has a convex surface corresponding to a curved inside surface (upper surface in FIG. 4) in which the side plate portion 1*b* rises from the main plate portion 1*a* of the wood 1-1. The convex surface of the upper mold frame B has the shape to which the inside surface of the wood 1-1 is fitted. The radius of curvature of a curved surface RI at the inside surface of the wood 1-1 and the radius of curvature of a curved surface RB at the upper mold frame B which is opposite to the curved surface RI have the correlation of RI>RB. After the lower mold frame A and the upper mold frame B are combined, i.e. after the wood 1-1 is compressed, a space formed between the concave surface of the lower mold frame A and the convex surface of the upper mold frame B has the shape of post-compression of the wood 1-1 (see FIG. 4B).

With reference to the wood 1-1 and the lower and upper mold frames A and B having the above-described configurations, first the wood 1-1 is placed in a water vapor atmosphere at high temperature and high pressure as shown in FIG. 4A. When the wood 1-1 is placed in the water vapor atmosphere at high temperature and high pressure for a predetermined time, the wood 1-1 is softened by excessively absorbing moisture. In the water vapor atmosphere at high temperature and high pressure, the wood 1-1 is arranged between the lower mold frame A and the upper mold frame B and on the concave surface of the lower mold frame A. At this point, in the wood 1-1, since the main plate portion 1*a* has the flat-grain surface, the direction M in which the pieces of grain G are laminated exists in the vertical direction of FIG. 4, and the fiber direction L is along a depth direction of FIG. 4.

Figure 4B:
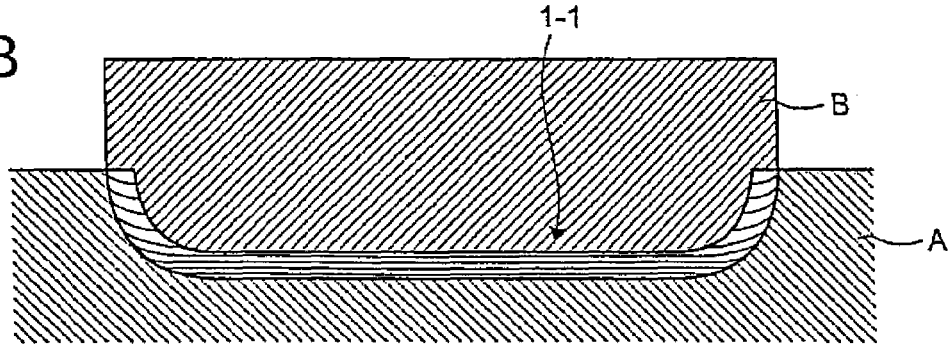

Then, as shown in FIG. 4B, the wood 1-1 is compressed by bringing the upper mold frame B close to the lower mold frame A. Namely the convex surface of the upper mold frame B is fitted into the concave surface of the lower mold frame A. In the wood 1-1 sandwiched between the lower mold frame A and the upper mold frame B, compressive force is applied to the main plate portion 1*a* in the thickness W1 direction (grain-G laminated direction M), and the compressive force is also applied to the main plate portion 1*a* in the direction intersecting (orthogonal to) the fiber direction L. Further, in the wood 1-1, the compressive force is applied to the side plate portion 1*b* in the thickness W2 direction (direction along the grain G) and in the height T1 direction (grain-G laminated direction), and the compressive force is also applied to the side plate portion 1*b* in the direction intersecting (orthogonal to) the fiber direction L. Further, in the wood 1-1, the compressive force is applied to a curved portion 1*c* which couples the main plate portion 1*a* and the side plate portion 1*b* in the grain-G laminated direction M and in the direction along the grain G, and the compressive force is also applied to the curved portion 1*c* in the direction intersecting (orthogonal to) the fiber direction L. Specifically, the curved portion 1*c* is formed so that the side plate portion 1*b* rises obliquely outward, and the radii of curvature of the lower and upper mold frames A and B have the relationship described above. Therefore, the compressive force is applied upward to the outside surface of the curved portion 1*c*, and the compressive force is applied downward to the inside surface. Then, the wood 1-1 is left for a predetermined time while the compressive force is applied to the wood 1-1.

Figure 4C:
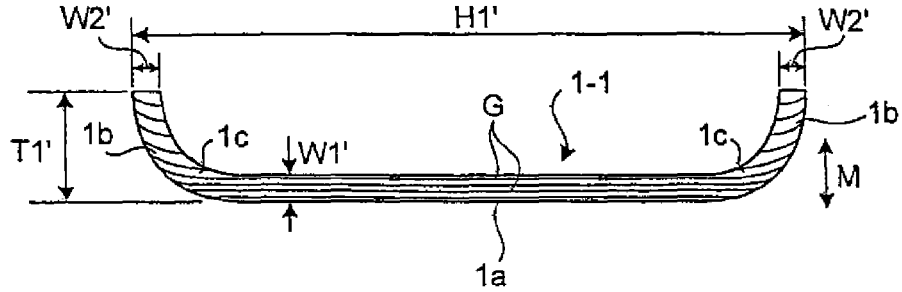

Finally, after the wood 1-1 is left for the predetermined time, the water vapor atmosphere at high temperature and high pressure is released, the upper mold frame B is separated from the lower mold frame A, and the compressed wood 1-1 is taken out as shown in FIG. 4C. In the compressed wood 1-1 taken out from between the lower and upper mold frames A and B, the wood 1-1 is compressed to substantially even thicknesses W1' and W2' at the main plated portion 1*a* and the side plate portion 1*b*, respectively. In the compressed wood 1-1, the side plate portion 1*b* is compressed to a height T1'. In the compressed wood 1-1, the curved portion 1*c* which couples the main plate portion 1*a* and the side plate portion 1*b* is compressed so that the pieces of grain G are deformed in the oblique direction. The compressed wood 1-1 is slightly compressed to a width H1'.

Thus, in the wood 1-1 compressed in the first embodiment, since the compressive force is applied in the direction intersecting (orthogonal to) the fiber direction L, the fiber density is increased, which imparts high strength to the overall wood 1-1. In the main plate portion 1*a* and the side plate portion 1*b*, since the compressive force is applied in the grain-G laminated direction M, the density of the hard fibers of the grain G is increased which imparts the high strength to the main plate portion 1*a* and the side plate portion 1*b*. In the curved portion 1*c* which couples the main plate portion 1*a* and the side plate portion 1*b*, since the compressive force is applied obliquely, the grain G is deformed in the oblique direction to increase the fiber density, which imparts the high strength to the curved portion 1*c*. The lengthwise direction of the shape of the wood 1-1 is taken along the fiber direction L, which imparts the strength in the lengthwise direction in which the strength is lower. As a result, the strength of the compressed wood product (electronic device exterior material) can be improved by the three-dimensional compression.

Second Embodiment

In a second embodiment described below, the descriptions similar to the contents described in FIGS. 1 to 3 in the first embodiment are neglected.

Figure 5A:
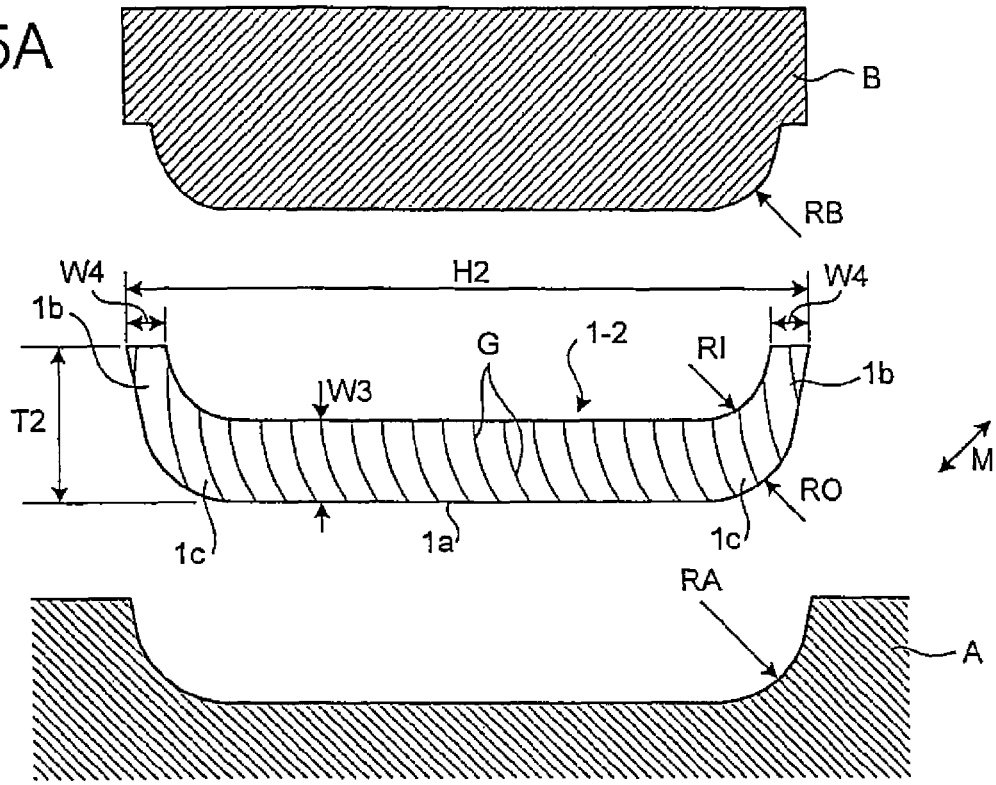
FIGS. 5A to 5C are views that depict a compression process in a second embodiment of the invention.

FIG. 5 is a view that depicts a compression process in the second embodiment. FIG. 5 shows the compression process of the wood 1-2 in which the main plate portion 1*a* has the edge-grain surface. The shape of the wood 1-2 is taken while the volume decreased by the compression is previously added. Specifically, as shown in FIG. 5A, the shape of the main plate portion 1*a* is taken with a thickness W3 in which the volume decreased by the compression is previously added. The shape of the side plate portion 1*b* is taken with a thickness W4 and a height T2 in which the volume decreased by the compression is previously added. The shape of the wood 1-2 is taken with a total width H2. The thickness W3 of the main plate portion 1*a* is formed larger than the thickness W4 of the side plate portion 1*b*. The middle portion between the main plate portion 1*a* and the side plate portion 1*b* is formed in the curve so that the thickness W3 of the main plate portion 1*a* is gradually changed to the thickness W4 of the side plate portion 1*b*. The side plate portion 1*b* is formed so as to rise obliquely outward from the main plate portion 1*a*. In the wood 1-2, FIG. 5 shows the shape of either the front cover 10*a* or the rear cover 10*b* in the exterior material 10 formed of the compressed wood product. The drawing and the description of the shape of the other are neglected because the shapes of the front cover 10*a* and the rear cover 10*b* are similar to each other.

The wood 1-2 is compressed between the lower mold frame A and the upper mold frame B. As shown in FIG. 5A, the lower mold frame A has the concave surface corresponding to the curved outside surface (lower surface in FIG. 5) in which the side plate portion 1*b* rises from the main plate portion 1*a* of the wood 1-2. The concave surface of the lower mold frame A has the shape to which the outside surface of the wood 1-2 is fitted. The radius of curvature of the curved surface RO at the outside surface of the wood 1-2 and the radius of curvature of the curved surface RA at the lower mold frame A which is opposite to the curved surface RO have the correlation of RO>RA. On the other hand, the upper mold frame B has the convex surface corresponding to the curved inside surface (upper surface in FIG. 5) in which the side plate portion 1*b* rises from the main plate portion 1*a* of the wood 1-2. The convex surface of the upper mold frame B has the shape to which the inside surface of the wood 1-2 is fitted. The radius of curvature of the curved surface RI at the inside surface of the wood 1-2 and the radius of curvature of the curved surface RB at the upper mold frame B which is opposite to the curved surface RI have the correlation of RI>RB. After the lower mold frame A and the upper mold frame B are combined, i.e. after the wood 1-2 is compressed, the space formed between the concave surface of the lower mold frame A and the convex surface of the upper mold frame B has the shape of post-compression of the wood 1-2 (see FIG. 5B).

With reference to the wood 1-2 and the lower and upper mold frames A and B having the above-described configuration, first the wood 1-2 is placed in the water vapor atmosphere at high temperature and high pressure as shown in FIG. 5A. When the wood 1-2 is placed in the water vapor atmosphere at high temperature and high pressure for a predetermined time, the wood 1-2 is softened by excessively absorbing the moisture. In the water vapor atmosphere at high temperature and high pressure, the wood 1-2 is arranged between the lower mold frame A and the upper mold frame B and on the concave surface of the lower mold frame A. At this point in the wood 1-2, since the main plate portion 1*a* has the edge-grain surface, the grain-G laminated direction M exists in the oblique direction of FIG. 5, and the fiber direction L is along the depth direction of FIG. 5.

Figure 5B:
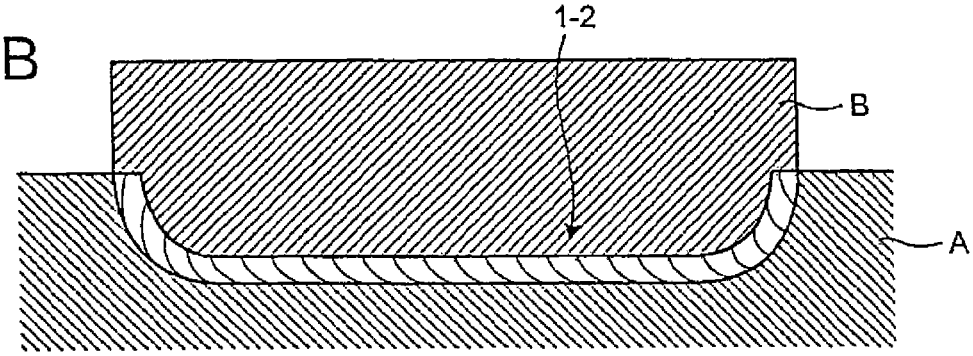

Then, as shown in FIG. 5B, the wood 1-2 is compressed by bringing the upper mold frame B close to the lower mold frame A. Namely, the convex surface of the upper mold frame B is fitted into the concave surface of the lower mold frame A. In the wood 1-2 sandwiched between the lower mold frame A and the upper mold frame B, the compressive force is applied to the main plate portion 1*a* in the thickness W3 direction (substantial grain-G laminated direction M), and the compressive force is also applied to the main plate portion 1*a* in the direction intersecting (orthogonal to) the fiber direction L. Further, in the wood 1-2, the compressive force is applied to the side plate portion 1*b* in the thickness W4 direction (substantially grain-G laminated direction M) and in the height T2 direction (direction substantially along the grain G), and the compressive force is also applied to the side plate portion 1*b* in the direction intersecting (orthogonal to) the fiber direction L. Further, in the wood 1-2, the compressive force is applied to one curved portion 1*c* (left side in FIG. 5) which couples the main plate portion 1*a* and the side plate portion 1*b* in the grain-G laminated direction M, and the compressive force is also applied to the other curved portion 1*c* (right side in FIG. 5) in the direction along the grain G and in the direction intersecting (orthogonal to) the fiber direction L. Specifically the curved portion 1*c* is formed so that the side plate portion 1*b* rises obliquely outward, and the radii of curvature of the lower and upper mold frames A and B have the relationship described above. Therefore, the compressive force is applied upward to the outside surface of the curved portion 1*c*, and the compressive force is applied downward to the inside surface. Then, the wood 1-2 is left for a predetermined time while the compressive force is applied to the wood 1-2.

Figure 5C:
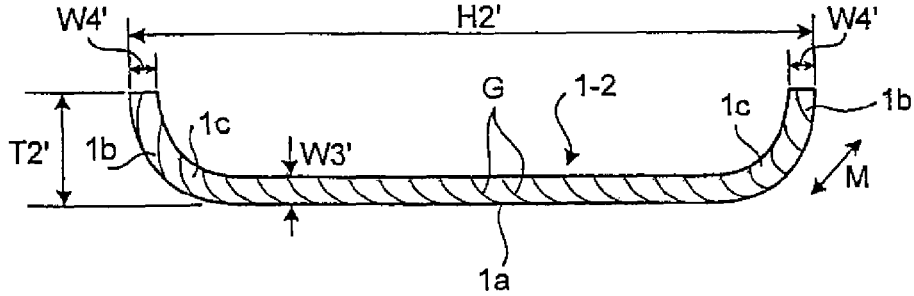

Finally, after the wood 1-2 is left for the predetermined time, the water vapor atmosphere at high temperature and high pressure is released, the upper mold frame B is separated from the lower mold frame A, and the compressed wood 1-2 is taken out as shown in FIG. 5C. In the compressed wood 1-2 which is taken out, the wood 1-2 is compressed to substantially even thicknesses W3' and W4' at the main plated portion 1*a* and the side plate portion 1*b*, respectively. In the compressed wood 1-2, the side plate portion 1*b* is compressed to a height T2'. In the curved portions 1*c* of the compressed wood 1-2, which couple the main plate portion 1*a* and the side plate portion 1*b*, one curved portion 1*c* (left side in FIG. 5) is compressed so that the pieces of grain G are laminated, and the other curved portion 1*c* (right side in FIG. 5) is compressed so that the pieces of grain G are curved and deformed. The compressed wood 1-2 is slightly compressed to a width H2'.

Thus, in the wood 1-2 compressed in the second embodiment, since the compressive force is applied in the direction intersecting (orthogonal to) the fiber direction L, the fiber density is increased, which imparts the high strength to the overall wood 1-2. In the main plate portion 1*a* and the side plate portion 1*b*, since the compressive force is applied in the grain-G laminated direction M, the density of the hard fibers of the grain G is increased, which imparts the high strength to the main plate portion 1*a* and the side plate portion 1*b*. In the curved portions 1*c* which couple the main plate portion 1*a* and the side plate portion 1*b*, since the compressive force is applied to one curved portion 1*c* (left side in FIG. 5) in the grain-C laminated direction M, the fiber density is increased, which imparts the high strength. Further, since the other curved portion 1*c* (right side in FIG. 5) is compressed so that the pieces of the grain G are curved and deformed, the fiber density is increased, which imparts the high strength. The lengthwise direction of the shape of the wood 1-2 is taken along the fiber direction L, which imparts the strength in the lengthwise direction in which the strength is lower. As a result, the strengths of the compressed wood product and the electronic device exterior material can be improved by the three-dimensional compression.

In the second embodiment, the woods 1-2 is applied, the shape of which is taken while main plate portion 1*a* thereof has the edge-grain surface. Therefore, since the grain G (fiber) emerges in higher density in the main plate portion 1*a* when compared with the first embodiment, the perspiration absorption characteristics are improved when the wood 1-2 comes into contact with a human hand to cause portability to be improved, and the grain G becomes a slip resistance. Further, the appearance of the wood is further improved because the grain G emerges in higher density in the main plate portion 1*a* when compared with the first embodiment.

Third Embodiment

In a third embodiment described below, the descriptions similar to the contents described in FIGS. 1 to 3 in the first embodiment are neglected.

Figure 6A:
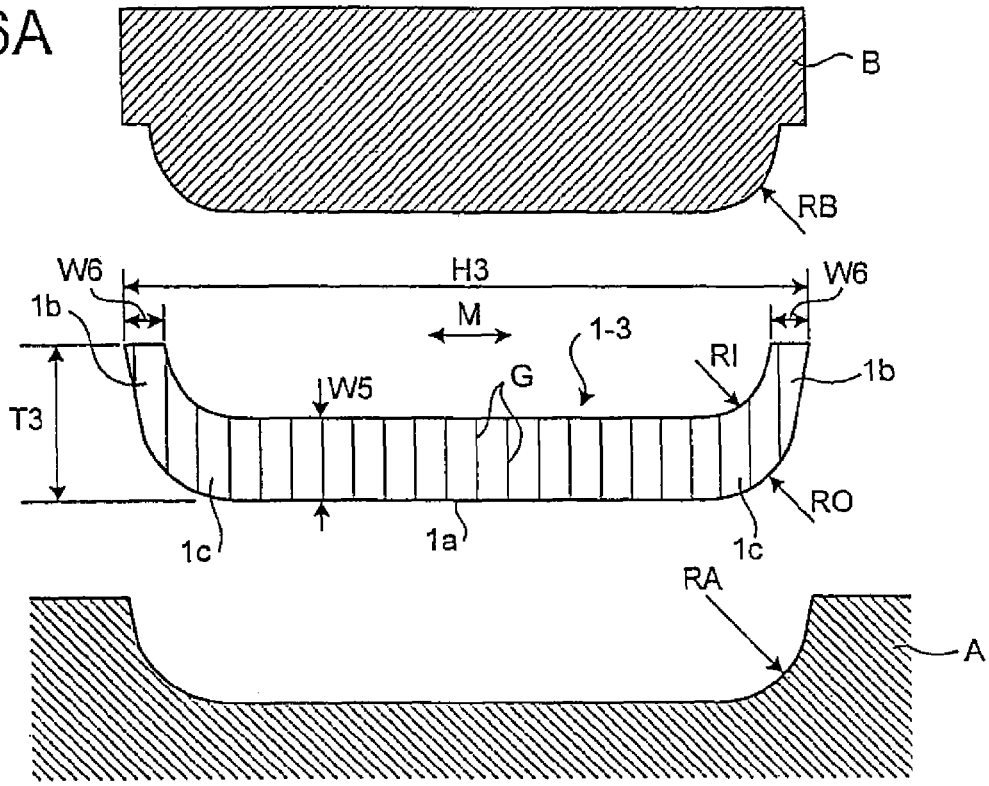
FIGS. 6A to 6C are views that depict a compression process in a third embodiment of the invention.

FIG. 6 is a view that depicts a compression process in the third embodiment. FIG. 6 shows the compression process of the wood 1-3 in which the main plate portion 1*a* has the straight-grain surface. The shape of the wood 1-3 is taken while the volume decreased by the compression is previously added. Specifically, as shown in FIG. 6A, the shape of the main plate portion 1*a* is taken with a thickness W5 in which the volume decreased by the compression is previously added. The shape of the side plate portion 1*b* is taken with a thickness W6 and a height T3 in which the volume decreased by the compression is previously added. The shape of the wood 1-3 is taken with a total width H3. The thickness W5 of the main plate portion 1*a* is formed larger than the thickness W6 of the side plate portion 1*b*. The middle portion between the main plate portion 1*a* and the side plate portion 1*b* is formed in the curve so that the thickness W5 of the main plate portion 1*a* is gradually changed to the thickness W6 of the side plate portion 1*b*. The side plate portion 1*b* is formed so as to rise obliquely outward from the main plate portion 1*a*. In the wood 1-3, FIG. 6 shows the shape of either the front cover 1*a* or the rear cover 10*b* in the exterior material 10 formed of the compressed wood product. The drawing and the description of the shape of the other are neglected because the shapes of the front cover 10*a* and the rear cover 10*b* are similar to each other.

The wood 1-3 is compressed between the lower mold frame A and the upper mold frame B. As shown in FIG. 6A, the lower mold frame A has the concave surface corresponding to the curved outside surface (lower surface in FIG. 6) in which the side plate portion 1*b* rises from the main plate portion 1*a* of the wood 1-3. The concave surface of the lower mold frame A has the shape to which the outside surface of the wood 1-3 is fitted. The radius of curvature of the curved surface RO at the outside surface of the wood 1-3 and the radius of curvature of the curved surface RA at the lower mold frame A which is opposite to the curved surface RO have the correlation of RO>RA. On the other hand, the upper mold frame B has the convex surface corresponding to the curved inside surface (upper surface in FIG. 6) in which the side plate portion 1*b* rises from the main plate portion 1*a* of the wood 1-3. The convex surface of the upper mold frame B has the shape to which the inside surface of the wood 1-3 is fitted. The radius of curvature of the curved surface RI at the inside surface of the wood 1-3 and the radius of curvature of the curved surface RB at the upper mold frame B which is opposite to the curved surface RI have the correlation of RI>RB. After the lower mold frame A and the upper mold frame B are combined, i.e. after the wood 1-3 is compressed, the space formed between the concave surface of the lower mold frame A and the convex surface of the upper mold frame B has the shape of post-compression of the wood 1-3 (see FIG. 6B).

With reference to the wood 1-3 and the lower and upper mold frames A and B having the above-described configuration, first the wood 1-3 is placed in the water vapor atmosphere at high temperature and high pressure as shown in FIG. 6A. When the wood 1-3 is placed in the water vapor atmosphere at high temperature and high pressure for a predetermined time, the wood 1-3 is softened by excessively absorbing the moisture. In the water vapor atmosphere at high temperature and high pressure, the wood 1-3 is arranged between the lower mold frame A and the upper mold frame B and on the concave surface of the lower mold frame A. At this point, in the wood 1-3, since the main plate portion 1*a* has the straight-grain surface, the grain-G laminated direction M exists in the horizontal direction of FIG. 6, and the fiber direction L is along the depth direction of FIG. 6.

Figure 6B:
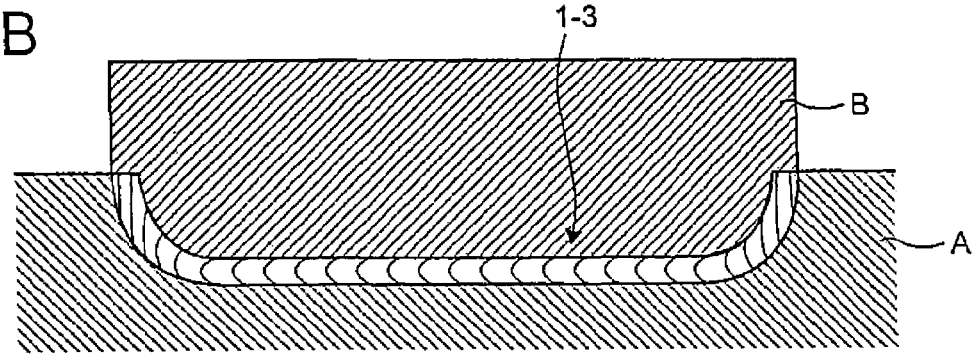

Then, as shown in FIG. 6B, the wood 1-3 is compressed by bringing the upper mold frame B close to the lower mold frame A. Namely the convex surface of the upper mold frame B is fitted into the concave surface of the lower mold frame A. In the wood 1-3 sandwiched between the lower mold frame A and the upper mold frame B, the compressive force is applied to the main plate portion 1*a* in the thickness W5 direction (direction along the grain G), and the compressive force is also applied to the main plate portion 1*a* in the direction intersecting (orthogonal to) the fiber direction L. Further, in the wood 1-3, the compressive force is applied to the side plate portion 1*b* in the thickness W6 direction (grain-G laminated direction M) and the height T3 direction (direction along the grain G), and the compressive force is also applied to the side plate portion 1*b* in the direction intersecting (orthogonal to) the fiber direction L. Further, in the wood 1-3, the compressive force is applied to the curved portion 1*c* which couples the main plate portion 1*a* and the side plate portion 1*b* in the grain-G laminated direction M and the direction along the grain G, and the compressive force is also applied to the curved portion 1*c* in the direction intersecting (orthogonal to) the fiber direction L. Specifically the curved portion 1*c* is formed so that the side plate portion 1*b* rises obliquely outward, and the radii of curvature of the lower and upper mold frames A and B have the relationship described above. Therefore, the compressive force is applied upward to the outside surface of the curved portion 1*c*, and the compressive force is applied downward to the inside surface. Then, the wood 1-3 is left for a predetermined time while the compressive force is applied to the wood 1-3.

Figure 6C:
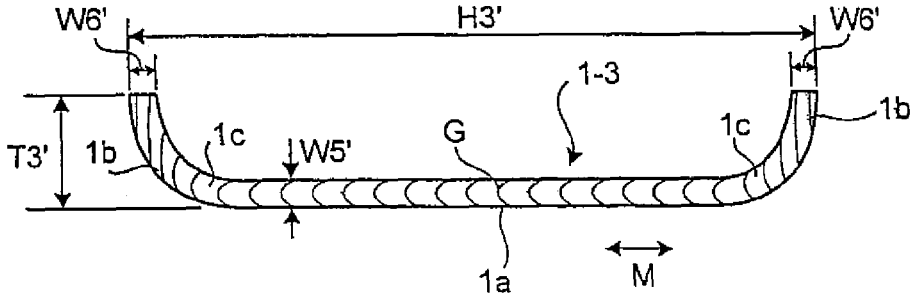

Finally, after the wood 1-3 is left for the predetermined time, the water vapor atmosphere at high temperature and high pressure is released, the upper mold frame B is separated from the lower mold frame A, and the compressed wood 1-3 is taken out as shown in FIG. 6C. In the compressed wood 1-3 taken out, the wood 1-3 is compressed to substantially even thicknesses W5' and W6' at the main plated portion 1*a* and the side plate portion 1*b*, respectively. In the compressed wood 1-3, the side plate portion 1*b* is compressed to a height T3'. In the compressed wood 1-3, the curved portion 1*c* which couples the main plate portion 1*a* and the side plate portion 1*b* is compressed so that the pieces of grain G are laminated. The compressed wood 1-3 is slightly compressed to a width H3'.

Thus, in the wood 1-3 compressed in the third embodiment, since the compressive force is applied in the direction intersecting (orthogonal to) the fiber direction L, the fiber density is increased, which imparts the high strength to the overall wood 1-3. Since the main plate portion 1*a* is compressed while the pieces of grain are curved and deformed, the pieces of fiber are bundled to increase the fiber density, which imparts the high strength to the main plate portion 1*a*. In the side plate portion 1*b*, since the compressive force is applied in the grain-G laminated direction M, the density of the hard fibers of the grain G is increased, which imparts the high strength to the side plate portion 1*b*. In the curved portion 1*c* which couples the main plate portion 1*a* and the side plate portion 1*b*, since the compressive force is applied in the grain-G laminated direction M, the fiber density is increased, which imparts the high strength. The lengthwise direction of the shape of the wood 1-3 is taken along the fiber direction L, which imparts the strength in the lengthwise direction in which the strength is lower. As a result, the strength of the compressed wood product and the electronic device exterior material can be improved by the three-dimensional compression.

In the third embodiment, the woods 1-3 is applied, the shape of which is taken while the main plate portion 1*a* thereof has the straight-grain surface. Therefore, since the grain G (fiber) emerges in higher density in the main plate portion 1*a* when compared with the first embodiment or the second embodiment, the perspiration absorption characteristics are improved when the wood 1-3 comes into contact with the human hand to cause portability to be improved, and the grain G becomes the slip resistance. Further, the appearance of the wood is further improved because the grain G emerges in higher density in the main plate portion 1*a* when compared with the first embodiment or the second embodiment.

Fourth Embodiment

In a fourth embodiment described below, the descriptions similar to the contents described in FIGS. 1 to 3 in the first embodiment are neglected.

Figure 7A:
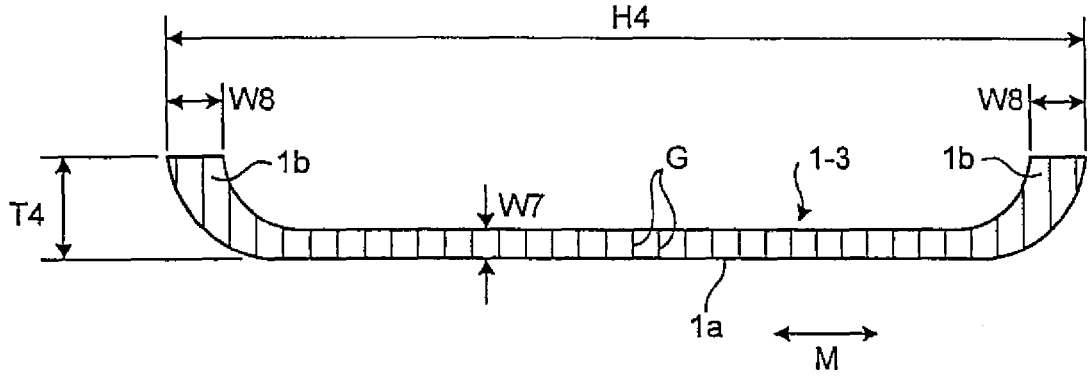
FIGS. 7A to 7B are views that depict a compression process in a fourth embodiment of the invention.
Figure 7B:
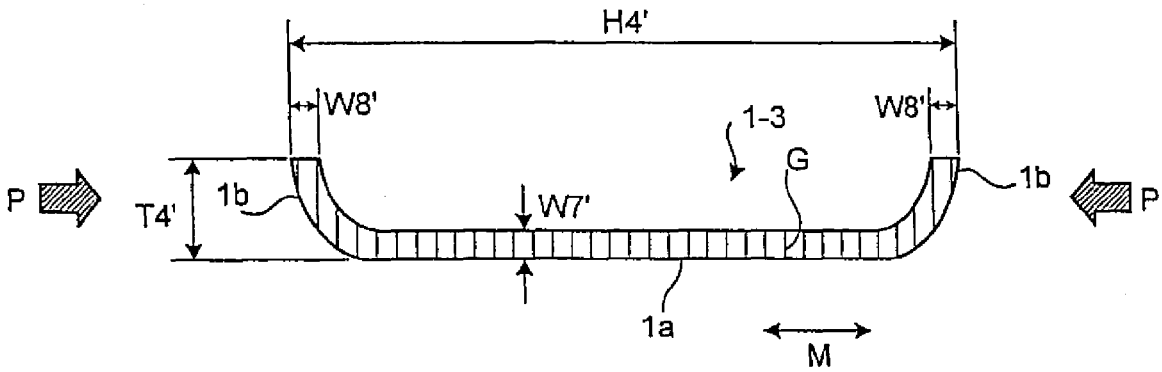

FIG. 7 is a view that depicts a compression process in the fourth embodiment. FIG. 7 shows the compression process of the wood 1-3 in which the main plate portion 1*a* has the straight-grain surface. The shape of the wood 1-3 is taken while the volume decreased by the compression is previously added. Specifically, as shown in FIG. 7A, the shape of the side plate portion 1*b* is taken with a thickness W8 in which the volume decreased by the compression is previously added, and the side plate portion 1*b* has a height T4 substantially equal to that of the post-compression. The main plate portion 1*a* has a thickness W7 substantially equal to the post-compression, and the shape of the wood 1-3 is taken with a width H4 in which the volume totally decreased by the compression is previously added. The thickness W8 of the side plate portion 1*b* is formed larger than the thickness W7 of the main plate portion 1*a*. The middle portion between the main plate portion 1*a* and the side plate portion 1*b* is formed in the curve so that the thickness W8 of the side plate portion 1*b* is gradually changed to the thickness W7 of the main plate portion 1*a*. In the wood 1-3, FIG. 7 shows the shape of either the front cover 10*a* or the rear cover 10*b* in the exterior material 10 formed of the compressed wood product. The drawing and the description of the shape of the other are neglected because the shapes of the front cover 10*a* and the rear cover 10*b* are similar to each other.

With reference to the wood 1-3 having the above-described configuration, first the wood 1-3 is placed in the water vapor atmosphere at high temperature and high pressure as shown in FIG. 7A. When the wood 1-3 is placed in the water vapor atmosphere at high temperature and high pressure for a predetermined time, the wood 1-3 is softened by excessively absorbing the moisture. At this point, in the wood 1-3, since the main plate portion 1*a* has the straight-grain surface, the grain-G laminated direction M exists in the horizontal direction of FIG. 7, and the fiber direction L is along the depth direction of FIG. 7.

Then, the wood 1-3 is compressed. At this point, the compression direction is an arrow P direction shown in FIG. 7B. Therefore, in the wood 1-3, the compressive force is applied to the main plate portion 1*a* in the width H4 direction (grain-G laminated direction M), and the compressive force is also applied to the main plate portion 1*a* in the direction intersecting (orthogonal to) the fiber direction L. Further, in the wood 1-3, the compressive force is applied to the side plate portion 1*b* in the thickness W8 direction (grain-G laminated direction M), and the compressive force is also applied to the side plate portion 1*b* in the direction intersecting (orthogonal to) the fiber direction L. Then, the wood 1-3 is left for a predetermined time while the compressive force is applied to the wood 1-3.

Finally, after the wood 1-3 is left for the predetermined time, the water vapor atmosphere at high temperature and high pressure is released, and the compressed wood 1-3 is taken out. In the compressed wood 1-3 taken out, the wood 1-3 is compressed to substantially even thicknesses W7' and W8' at the main plated portion 1*a* and the side plate portion 1*b*, respectively. In the compressed wood 1-3, the side plate portion 1*b* is compressed to a height T4' substantially equal to the height T4 in the pre-compression. The compressed wood 1-3 is compressed to a width H4'.

Thus, in the wood 1-3 compressed in the fourth embodiment, since the compressive force is applied in the direction intersecting (orthogonal to) the fiber direction L, the fiber density is increased, which imparts the high strength to the overall wood 1-3. Since the main plate portion 1*a* and the side plate portion 1*b* are compressed in the grain-G laminated direction M, the density of the hard fibers of the grain G is increased, which imparts the high strength to the main plate portion 1*a* and the side plate portion 1*b*. The lengthwise direction of the shape of the wood 1-3 is taken along the fiber direction L, which imparts the strength in the lengthwise direction in which the strength is lower. As a result, the strength of the compressed wood product and the electronic device exterior material can be improved by the three-dimensional compression.

In the fourth embodiment, the wood 1-3 is applied, the shape of which is taken while the main plate portion 1*a* thereof has the straight-grain surface. Therefore, since the grain G (fiber) emerges in higher density in the main plate portion 1*a* when compared with the first embodiment or the second embodiment, the perspiration absorption characteristics are improved when the wood 1-3 comes into contact with the human hand to cause portability to be improved, and the grain G becomes the slip resistance. Further, the appearance of the wood is further improved because the grain G emerges in higher density in the main plate portion 1*a* when compared with the first embodiment or the second embodiment.

Fifth Embodiment

In a fifth embodiment described below, the descriptions similar to the contents described in FIGS. 1 to 3 in the first embodiment are neglected.

Figure 8A:
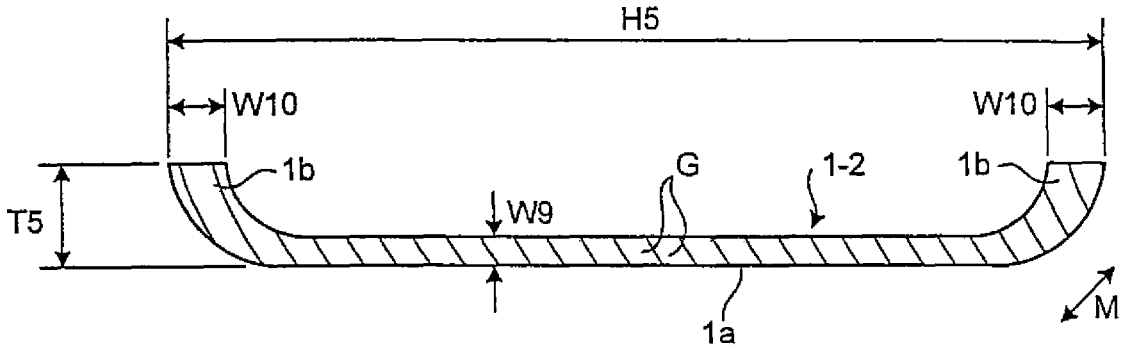
FIGS. 8A to 8B are views that depict a compression process in a fifth embodiment of the invention.
Figure 8B:
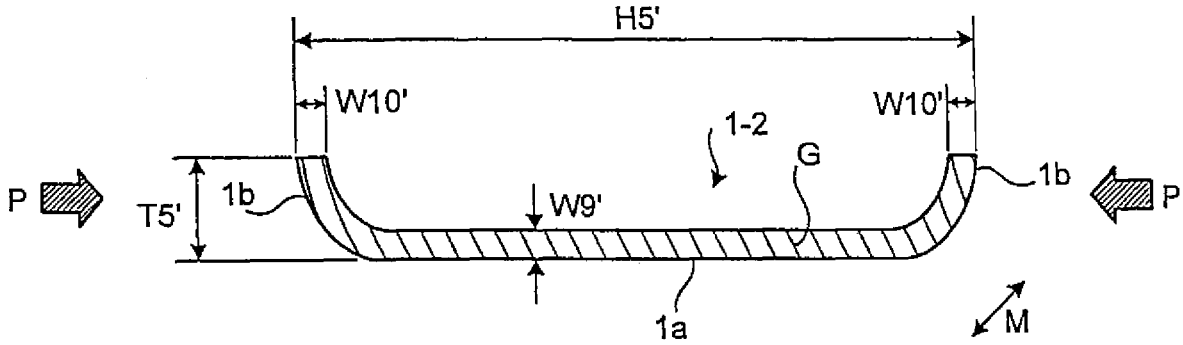

FIG. 8 is a view that depicts a compression process in the fifth embodiment. FIG. 8 shows the compression process of the wood 1-2 in which the main plate portion 1*a* has the edge-grain surface. The shape of the wood 1-2 is taken while the volume decreased by the compression is previously added. Specifically, as shown in FIG. 8A, the shape of the side plate portion 1*b* is taken with a thickness W10 in which the volume decreased by the compression is previously added, and the side plate portion 1*b* has a height T5 substantially equal to that of the post-compression. The main plate portion 1*a* has a thickness W9 substantially equal to the post-compression, and the shape of the wood 1-2 is taken with a width H5 in which the volume totally decreased by the compression is previously added. The thickness W10 of the side plate portion 1*b* is formed larger than the thickness W9 of the main plate portion 1*a*. The middle portion between the main plate portion 1*a* and the side plate portion 1*b* is formed in the curve so that the thickness W10 of the side plate portion 1*b* is gradually changed to the thickness W9 of the main plate portion 1*a*. In the wood 1-2, FIG. 8 shows the shape of either the front cover 10*a* or the rear cover 10*b* in the exterior material 10 formed of the compressed wood product. The drawing and the description of the shape of the other are neglected because the shapes of the front cover 10*a* and the rear cover 10*b* are similar to each other.

With reference to the wood 1-2 having the above-described configuration, first the wood 1-2 is placed in the water vapor atmosphere at high temperature and high pressure as shown in FIG. 8A. When the wood 1-2 is placed in the water vapor atmosphere at high temperature and high pressure for a predetermined time, the wood 1-2 is softened by excessively absorbing the moisture. At this point, in the wood 1-2, since the main plate portion 1*a* has the edge-grain surface, the grain-G laminated direction M exists in the oblique direction of FIG. 8, and the fiber direction L is along the depth direction of FIG. 8.

Then, the wood 1-2 is compressed. At this point, the compression direction is the arrow P direction shown in FIG. 8B. Therefore, in the wood 1-2, the compressive force is applied to the main plate portion 1*a* in the width H5 direction (substantial grain-G laminated direction), and the compressive force is also applied to the main plate portion 1*a* in the direction intersecting (orthogonal to) the fiber direction L. Further, in the wood 1-2, the compressive force is applied to the side plate portion 1*b* in the thickness W10 direction (substantial grain-G laminated direction M), and the compressive force is also applied to the side plate portion 1*b* in the direction intersecting (orthogonal to) the fiber direction L. Then, the wood 1-2 is left for a predetermined time while the compressive force is applied to the wood 1-2.

Finally, after the wood 1-2 is left for the predetermined time, the water vapor atmosphere at high temperature and high pressure is released, and the compressed wood 1-2 is taken out. In the compressed wood 1-2 taken out, the wood 1-2 is compressed to substantially even thicknesses W9' and W10' at the main plated portion 1*a* and the side plate portion 1*b*, respectively. In the compressed wood 1-2, the side plate portion 1*b* is compressed to a height T5' substantially equal to the height T5 in the pre-compression. The compressed wood 1-2 is compressed to a width H5'.

Thus, in the wood 1-2 compressed in the fifth embodiment, since the compressive force is applied in the direction intersecting (orthogonal to) the fiber direction L, the fiber density is increased, which imparts the high strength to the overall wood 1-2. Since the main plate portion 1*a* and the side plate portion 1*b* are compressed in the grain-G laminated direction M, the density of the hard fibers of the grain G is increased, which imparts the high strength to the main plate portion 1*a* and the side plate portion 1*b*. The lengthwise direction of the shape of the wood 1-2 is taken along the fiber direction L, which imparts the strength in the lengthwise direction in which the strength is lower. As a result, the strength of the compressed wood product and the electronic device exterior material can be improved by the three-dimensional compression.

In the fifth embodiment, the wood 1-2 is applied, the shape of which is taken while the main plate portion 1*a* has the edge grain surface. Therefore, since the grain G (fiber) emerges in higher density in the main plate portion when compared with the first embodiment, the perspiration absorption characteristics are improved when the wood 1-2 comes into contact with the human hand to cause portability to be improved, and the grain G becomes the slip resistance. Further, the appearance of the wood is further improved because the grain G emerges in higher density in the main plate portion 1*a* when compared with the first embodiment.

It is possible to burn the surface of the wood 1 (compressed wood product) obtained by the compression in the first embodiment to the fifth embodiment. Depressions and projections are generated in the grain G portion by burning the surface of the wood 1, which results in effects of the perspiration absorption characteristics and the slip resistance from the beginning of use. Further, a carbonized layer obtained by burning the surface of the wood 1 becomes a conductive material, and the carbonized layer becomes an electromagnetic shielding material which is far lighter than metal, so that the wood 1 obtained by the compression in the first embodiment to the fifth embodiment can be used effectively as the electronic device exterior material.

In the first embodiment to the fifth embodiment, the compressed wood product having the structure in which the side plate portion 1*b* rises from the main plate portion 1*a* is described as an example. However, the invention is not limited to the first embodiment to the fifth embodiment. As described above, the invention can be applied to any shape of goods, e.g. tableware, as long as the strength is obtained by applying the compressive force in the direction intersecting (orthogonal to) the fiber direction L of the wood 1. For the electronic device exterior material, the invention is not limited to the digital camera, but the invention can be applied to the portable electronic device such as a camera, a mobile communication device (mainly cellular phone), an IC recorder, a PDA, a portable television, a portable radio, and a remote control for various home appliances.

It is known that the strength of the wood is varied depending on the compression direction with respect to the wood. Namely, sometimes there is a fear that the wood is broken by the compression. Particularly, when the wood is three-dimensionally processed, it is necessary to take the compression direction with respect to the wood into consideration. In the conventional arts described above, the wood is first compressed in a certain compression direction, and then the wood is compressed (pressed) in the direction different from the previous compression direction, so that there is a possibility that the wood is broken.

However, in the embodiments explained above, the compressed wood product and the electronic device exterior material according to the present invention are suitable for the improvement of the strength of the wood by previously considering the compression direction with respect to the wood to take the shape of the wood and performing the compression forming.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method of processing wood through compression, comprising:

forming an uncompressed shaped wood piece from a raw wood, the uncompressed shaped wood piece including a main plate portion and a side plate portion that couples to an entire periphery of the main plate portion and has a height higher than the main plate portion; and compressing the uncompressed shaped wood piece to form a compressed wood piece, wherein during said compressing the main plate portion is subjected to compressive force in a thickness direction of the main plate portion, the side plate portion is subjected to compressive force in a thickness direction and a height direction of the side plate portion, and the thickness direction of the main plate portion is a direction intersecting a fiber direction of the uncompressed shaped wood piece.

2. The method of processing wood according to claim 1, wherein the uncompressed shaped wood piece further includes a curved portion provided between the main plate portion and the side plate portion, and the curved portion during said compressing is subjected to both the compressive force to which the main plate portion is subjected and the compressive force to which the side plate portion is subjected.

3. The method of processing wood according to claim 1, wherein the surface of the main plate portion has a flat-grain pattern.

4. The method of processing wood according to claim 1, wherein a lengthwise direction of the uncompressed shaped wood piece is along the fiber direction of the uncompressed shaped wood piece.

* * * * *